US006263686B1

(12) United States Patent
Burkhart

(10) Patent No.: US 6,263,686 B1
(45) Date of Patent: Jul. 24, 2001

(54) DEFROST CONTROL METHOD AND APPARATUS

(75) Inventor: Larry James Burkhart, Indianapolis, IN (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/612,709

(22) Filed: Jul. 10, 2000

(51) Int. Cl.[7] ..... F25B 47/02
(52) U.S. Cl. ..... 62/155; 62/234; 62/230
(58) Field of Search ..... 62/80, 151, 152, 62/154, 155, 156, 234, 230

(56) References Cited

U.S. PATENT DOCUMENTS 5,148,686 * 9/1992 You ..... 62/234
5,257,506 11/1993 DeWolf et al. ..... 62/80
5,469,715 * 11/1995 Janke et al. ..... 62/155
6,026,651 * 2/2000 Sandelman ..... 62/155
6,131,400 * 10/2000 Seok et al. ..... 62/155 X

* cited by examiner

*Primary Examiner*—Harry B. Tanner
(74) *Attorney, Agent, or Firm*—Wall Marjama & Bilinski

(57) ABSTRACT

In a time and temperature controlled defrost cycle for a heat pump system, defrost cycles are controlled by two variables: elapsed time since the last defrost cycle, and the refrigerant temperature in the outdoor coil. The elapsed time variable for the first defrost cycle after power-up is set less than the elapsed time variable required for subsequent defrost cycles. Thus, the system is not vulnerable to planned cyclical power outages if the power outage cycle time is less than the elapsed time variable required between regular defrost cycles.

6 Claims, 2 Drawing Sheets

DEFROST CONTROL METHOD AND APPARATUS

FIELD OF THE INVENTION

This invention relates generally to heat pump systems, and more particularly to an apparatus and method for controlling a defrost cycle for effecting defrost of an outdoor heat exchanger coil.

BACKGROUND OF THE INVENTION

Air conditioners, refrigerators, and heat pumps produce a controlled heat transfer by evaporating a liquid refrigerant in a heat exchanger under appropriate pressure conditions to produce the desired evaporator temperatures. Liquid refrigerant removes its latent heat of vaporization from the medium being cooled, being converted into a vapor at the same pressure and temperature. This vapor is then conveyed into a compressor where its temperature and pressure are increased. The vapor then is conducted to a separate heat exchanger serving as a condenser where the gaseous refrigerant absorbs its heat of condensation from a heat transfer fluid in heat exchange relation therewith, changing state from a gas to a liquid. The liquid is supplied to an evaporator after flowing through an expansion device which acts to reduce the pressure of the liquid refrigerant so that the liquid refrigerant evaporates within the evaporator to absorb its heat of vaporization and complete the cycle.

During the heating mode, a heat pump circuit uses an outdoor heat exchanger coil which serves as the evaporator. The evaporator is typically located in ambient air, which sometimes drops to temperatures below the freezing point of water. Thus, as the cold ambient air circulates over the outdoor coil, water vapor in the air condenses and freezes on the surfaces of the outdoor coil. As frost accumulates on the outdoor coil, a layer of ice builds up between the portion of the outdoor coil carrying refrigerant and the air flowing over it. This layer of ice acts as an insulating layer inhibiting the heat transfer in the coil between the refrigerant and the air. In addition, the ice may block narrow air flow passageways between fins used to enhance heat transfer. This additional effect further reduces the heat transfer since lesser amounts of air are circulated in heat exchange relation with the refrigerant carrying conduits.

It is necessary to remove the accumulated frost to efficiently operate a heat pump in relatively low outdoor ambient air conditions. Many conventional methods are known such as supplying electric resistance heat, reversing the heat pump such that the evaporator becomes a condenser, or other refrigerant circuiting techniques to direct hot gaseous refrigerant directly to the frosted heat exchanger. Many of these defrost techniques use energy that is therefore not used to transfer heat energy to the space to be heated. To reduce the amount of heat energy used in the defrost operation, it is desirable to use a defrost system which places the refrigeration circuit in the defrost mode only when it is determined that too much frost has accumulated on the outdoor coil. Defrost control systems must know what a clean coil status is in order to determine the correct time to initiate a defrost cycle for best performance.

Different types of control systems are used to initiate defrost. A combination of a timer and a thermostat may be used to determine when to initiate defrost. The thermostat periodically checks to see whether or not the outdoor refrigerant temperature or a temperature dependent thereon is below a selected level, and if so, acts to place the system in defrost till the coil temperature is warmed enough to assure frost removal or for a length of time dependent on the timer. Other types of prior art defrost initiation systems include measuring infrared radiation emitted from the fins of the refrigerant carrying coil, measuring the air pressure differentials of the air flow flowing through the heat exchanger, measuring the temperature difference between the coil and the ambient air, using an electrical device placed on the fin whose characteristics change depending on the temperature of the device, optical-electrical methods and other methods involving the monitoring of various electrical parameters.

Defrost controls used today typically reset the timing function upon powering up the system. A time temperature defrost typically requires a 90 minute time cycle to elapse before allowing the system to move into defrost mode. This is usually not a problem, since the system is only powered up when initially installed or after a loss of power caused by a storm, which is very infrequent. However, electric utility companies are increasingly using power blackouts in certain areas of the country to reduce their system loading. This predominantly occurs during the colder seasons in the Southeastern United States where heat pumps and electric heating are both common. A problem results in that these power blackouts typically occur for 10 minutes each hour. Thus, the heat pump has its defrost timer reset every 60 minutes, which is less than the typical 90 minute minimum between defrost cycles. The missed defrost cycles cause the system to build up frost and suffer performance degradation, frequently resulting in service calls from the homeowner who believes that the heat pump is not working properly. **Any type of defrost control which does not include a memory of coil frost condition before shut down would require this type of early timed defrost, if the unit powers up with the coil not being proven as clear of frost.

SUMMARY OF THE INVENTION

Briefly stated, in a time and temperature controlled defrost cycle for a heat pump system, defrost cycles are controlled by two variables: elapsed time since the last defrost cycle, and the refrigerant temperature in the outdoor coil. The elapsed time variable for the first defrost cycle after power-up is set less than the elapsed time variable required for subsequent defrost cycles. Thus, the system is not vulnerable to planned cyclical power outages if the power outage cycle time is less than the elapsed time variable required between regular defrost cycles. Demand defrost systems would also require an early time defrost cycle if no memory is stored concerning coil frost condition.

According to an embodiment of the invention, a method of controlling when to initiate a defrost cycle to remove accumulated frost from an outdoor heat exchanger coil forming a portion of a refrigerant heat pump system including a compressor, includes the steps of (a) sensing a temperature of the refrigerant in the outdoor heat exchanger coil; (b) determining whether a prior defrost cycle has occurred since system power-up; (c) determining a first elapsed time since the prior defrost cycle, if any; (d) determining a second elapsed time since system power-up; (c) initiating the defrost cycle if no prior defrost cycle has occurred since system power-up and the second elapsed time exceeds a first predetermined time; and (f) initiating the defrost cycle if the prior defrost cycle has occurred since system power-up and the first elapsed time exceeds a second predetermined time.

According to an embodiment of the invention, an apparatus for controlling when to initiate a defrost cycle to remove accumulated frost from an outdoor heat exchanger coil forming a portion of a refrigerant heat pump system including a compressor includes means for sensing a temperature of the refrigerant in the outdoor heat exchanger coil; means for determining whether a prior defrost cycle has occurred since system power-up; means for determining a first elapsed time since the prior defrost cycle, if any; means for determining a second elapsed time since system power-up; means for initiating the defrost cycle if no prior defrost cycle has occurred since system power-up and the second elapsed time exceeds a first predetermined time; and means for initiating the defrost cycle if the prior defrost cycle has occurred since system power-up and the first elapsed time exceeds a second predetermined time.

DETAILED DESCRIPTION OF THE PREFERRED EMBODIMENT

Figure 1:
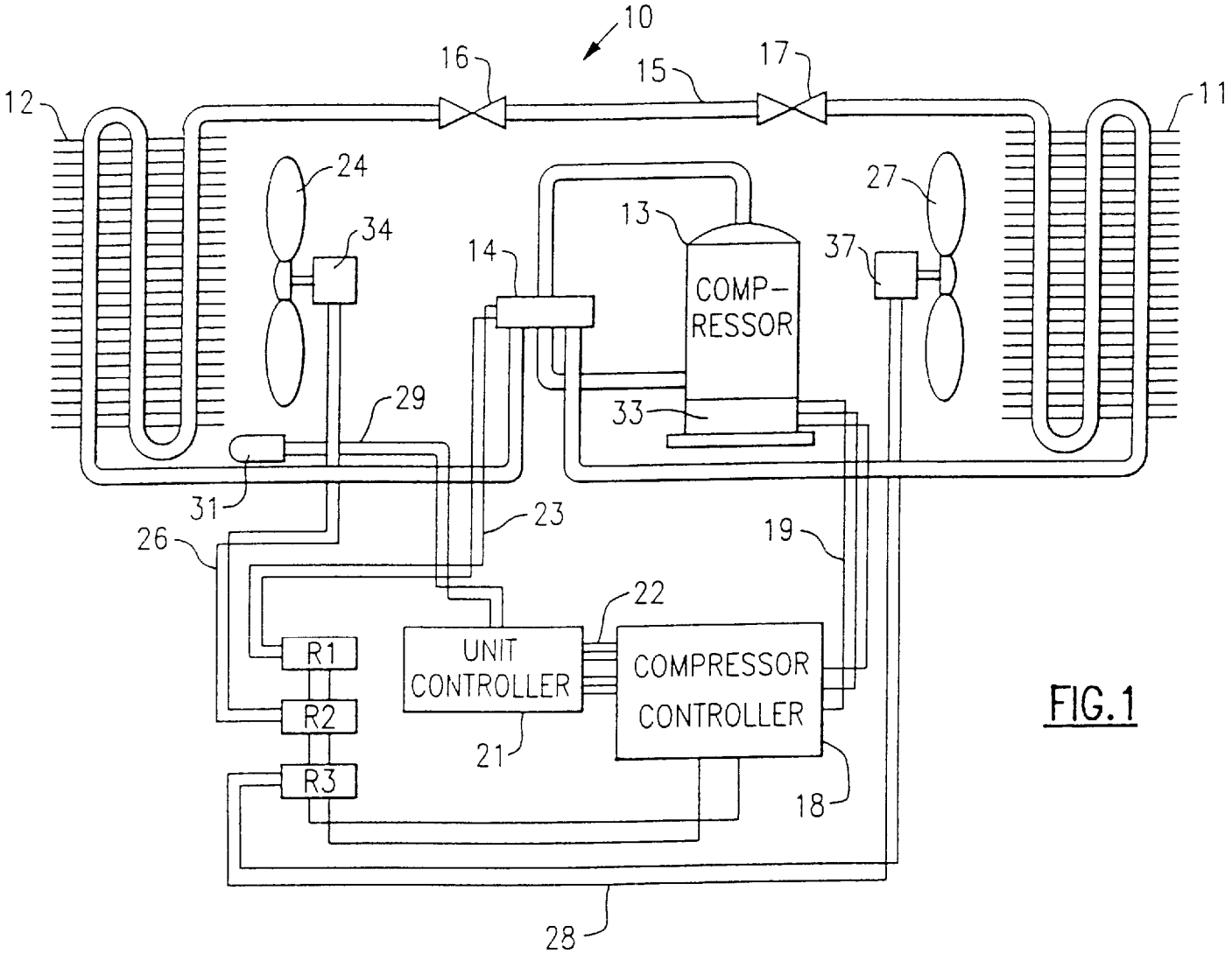
FIG. 1 shows a heat pump system according to an embodiment of the invention.

Referring to FIG. 1, a heat pump system 10 includes an indoor coil 11, an outdoor coil 12, a compressor 13 and a reversing valve 14. Expansion valves 16, 17 are installed in a line 15 which connects indoor and outdoor coils 11 and 12. Each expansion valve 16, 17 includes means for bypassing refrigerant when it is not acting as an expansion device. All of these components operate in a rather conventional heat pump manner to provide cooling to the indoor space while operating in air conditioning mode and heating to the indoor space while operating in heating mode.

Although the present invention is equally applicable to either constant speed or variable speed systems, it is described with reference to a constant speed system. Such a system contemplates the use of multi-speed motors such as, for example, a two speed compressor motor. A motor 33 drives compressor 13, which is normally located in the outdoor section of system 10 near outdoor coil 12. A motor 37 drives a fan 27 for indoor coil 11, while a motor 34 drives an outdoor fan 24 for outdoor coil 12. A compressor controller 18 coordinates the operation of the compressor and its associated equipment.

Controller 18 is electrically connected to compressor motor 33 by leads 19 and to a unit controller 21 by leads 22. Controller 18 and controller 21 are optionally combined into one controller. Unit controller 21 is connected to a reversing valve 14 by a way of a relay R1 and leads 23. Reversing valve 14 controls the refrigerant flow depending on whether system 10 is in heating, cooling, or defrost mode. Controller 21 also controls outdoor coil fan motor 34 by way of relay R2 and leads 26 and indoor coil fan motor 37 by way of relay R3 and leads 28. In addition, the unit controller 21 is electrically connected to an outdoor coil thermistor 31 by way of leads 29. Unit controller 21 tracks and stores operating system variables such as compressor run time and time between defrosts.

In what is known as a "time and temperature" system, as soon as the coil temperature as measured by thermistor 31 is less than a specified number, such as 30° F., frost on outdoor coil 12 is assumed, and at least a specified period of time, such as 90 minutes of operational time, has elapsed since the last defrost cycle, system 10 enters the defrost mode.

In the present invention, upon power-up of system 10, many, if not all, variables stored in unit controller 21 are reinitialized. At the time of reinitialization, the specified period of time that must elapse before running the first defrost cycle is a predetermined period of time that is shorter than the cycle time for subsequent defrost periods. In the preferred embodiment, the first period defrost cycle time is 30 minutes, with subsequent defrost cycle periods of 60 or 90 minutes.

Figure 2:
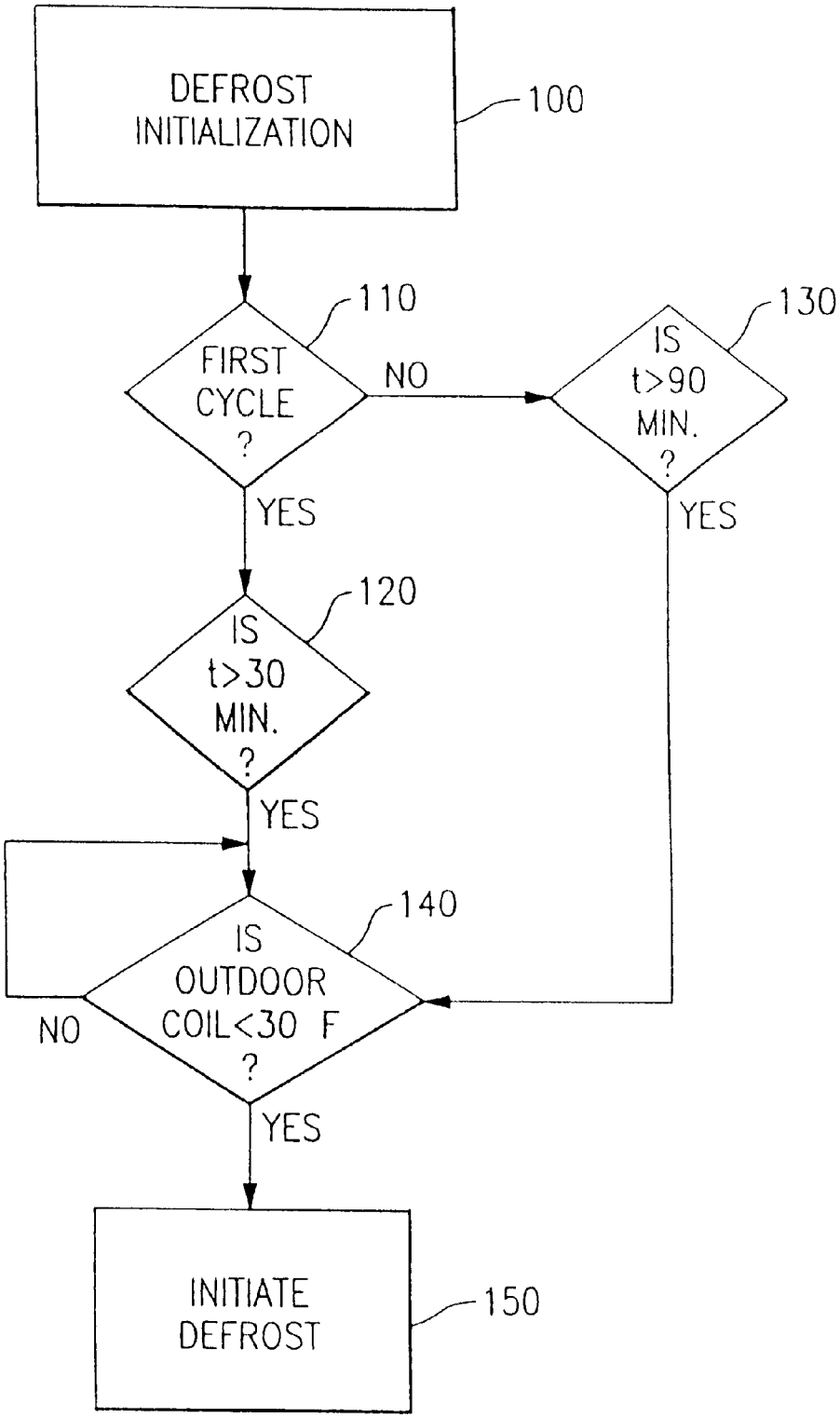
FIG. 2 shows a flow chart of the method of the present invention.

Referring to FIG. 2, a flow chart of the method of the present invention is shown. The process begins in step 100 where the system variables are initialized, including the defrost cycle elapsed time. In step 110, the system checks to see if this is the first cycle, and if so, goes to step 120. If not, the system goes to step 130, where the elapsed time is checked to see if it exceeds 90 minutes. If so, the outdoor coil temperature is checked in step 140. In step 120, the elapsed time is checked to see if it exceeds 30 minutes, and if so, the process control passes to step 140 to check the outdoor coil temperature. If the outdoor coil temperature is less than 30° F., the defrost cycle is initiated in step 150. Otherwise, the system periodically checks to see if the outdoor coil temperature drops below 30° F.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A method of controlling when to initiate a defrost cycle to remove accumulated frost from an outdoor heat exchanger coil forming a portion of a refrigerant heat pump system including a compressor, comprising the steps of:

determining whether a prior defrost cycle has occurred since system power-up;

determining a first elapsed time since said prior defrost cycle, if any;

determining a second elapsed time since system power-up;

initiating said defrost cycle if no prior defrost cycle has occurred since system power-up and said second elapsed time exceeds a first predetermined time; and initiating said defrost cycle if said prior defrost cycle has occurred since system power-up and said first elapsed time exceeds a second predetermined time.

2. A method according to claim 1, further comprising the step of sensing a temperature of said refrigerant in said outdoor heat exchanger coil.

3. A method according to claim 1, further comprising the step of determining if frost is present on said outdoor heat exchanger coil.

4. An apparatus for controlling when to initiate a defrost cycle to remove accumulated frost from an outdoor heat exchanger coil forming a portion of a refrigerant heat pump system including a compressor, comprising:

means for determining whether a prior defrost cycle has occurred since system power-up;

means for determining a first elapsed time since said prior defrost cycle, if any;

means for determining a second elapsed time since system power-up;

means for initiating said defrost cycle if no prior defrost cycle has occurred since system power-up and said second elapsed time exceeds a first predetermined time; and means for initiating said defrost cycle if said prior defrost cycle has occurred since system power-up and said first elapsed time exceeds a second predetermined time.

5. An apparatus according to claim 4, further comprising means for sensing a temperature of said refrigerant in said outdoor heat exchanger coil.

6. An apparatus according to claim 4, further comprising means for determining if frost is present on said outdoor heat exchanger coil.

* * * * *